US008140190B2

(12) United States Patent
Ferragut, II et al.

(10) Patent No.: US 8,140,190 B2
(45) Date of Patent: Mar. 20, 2012

(54) UNIVERSAL CONTROLLER FOR A DOMESTIC APPLIANCE

(75) Inventors: Nelson J. Ferragut, II, Williamsburg, IA (US); Robert L. Wetekamp, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 1748 days.

(21) Appl. No.: 11/327,411

(22) Filed: Jan. 9, 2006

(65) Prior Publication Data

US 2007/0157642 A1 Jul. 12, 2007

(51) Int. Cl.

| | |
|---|---|
| ***A47F 3/04*** | (2006.01) |
| ***G05B 11/01*** | (2006.01) |
| ***G05B 15/00*** | (2006.01) |
| ***G05B 23/02*** | (2006.01) |
| ***G06F 7/00*** | (2006.01) |
| ***G06K 9/18*** | (2006.01) |

(52) U.S. Cl. ..... 700/275; 700/17; 700/220; 62/252; 340/3.71; 382/183

(58) Field of Classification Search ..... 340/3.1, 340/539.14, 3.3, 3.71, 572.1; 700/9, 17, 700/20, 83, 220, 275; 62/246, 252, 255, 62/382; 219/620; 382/100, 181, 183; 455/403; 709/220

See application file for complete search history.

(56) References Cited

U.S. PATENT DOCUMENTS

| | | | |
|---|---|---|---|
| 3,622,990 | A | 11/1971 | Lerch et al. |
| 3,911,943 | A | 10/1975 | Athey et al. |
| 4,275,464 | A | 6/1981 | Schmidt |
| 4,320,386 | A | 3/1982 | Harris |
| 4,400,699 | A | 8/1983 | Glasmacher |
| 4,431,988 | A | 2/1984 | Molusis et al. |
| 4,500,933 | A | 2/1985 | Chan |

(Continued)

FOREIGN PATENT DOCUMENTS

EP 123099 A1 * 10/1984

(Continued)

OTHER PUBLICATIONS

Rogers, Michael. "Kitchens aren't just for cooking anymore". Oct. 31, 2005. http://www.msnbc.msn.com/id/9745953/ns/technology_and_science-tech_and_gadgets/t/kitchens-arent-just-cooking-anymore/Click%20for%20profile.*

(Continued)

*Primary Examiner* — Albert Decady
*Assistant Examiner* — Jennifer Norton
(74) *Attorney, Agent, or Firm* — Kirk W. Goodwin; Diederiks & Whitelaw, PLC

(57) ABSTRACT

A domestic appliance, shown in the form of a refrigerator, includes a cabinet within which is defined at least one compartment. A controller is mounted to the appliance for controlling various operating parameters of the appliance. The controller also includes a memory having stored therein a plurality of operating parameters associated with a plurality of appliance models. The appliance has an identification element affixed thereto and a communication device that is operatively connected to the controller. The communication device receives signals that provide programming instructions to the controller to activate particular ones of the plurality of operating parameters associated with the respective appliance model. In this manner, a universal controller can be employed in any one of a wide range of appliance models.

15 Claims, 2 Drawing Sheets

U.S. PATENT DOCUMENTS

| | | | | |
|---|---|---|---|---|
| 4,703,306 | A | 10/1987 | Barritt | |
| 4,834,169 | A * | 5/1989 | Tershak et al. | 165/233 |
| 5,306,995 | A * | 4/1994 | Payne et al. | 318/561 |
| 5,349,344 | A * | 9/1994 | Head | 340/825.23 |
| 5,412,291 | A | 5/1995 | Payne et al. | |
| 5,524,362 | A * | 6/1996 | Quandt et al. | 34/526 |
| 5,619,614 | A | 4/1997 | Payne et al. | |
| 5,647,231 | A * | 7/1997 | Payne et al. | 68/12.01 |
| 6,073,201 | A | 6/2000 | Jolley et al. | |
| 6,225,938 | B1 * | 5/2001 | Hayes et al. | 341/176 |
| 6,342,901 | B1 * | 1/2002 | Adler et al. | 715/700 |
| 6,397,606 | B1 | 6/2002 | Roh et al. | |
| 6,515,653 | B2 | 2/2003 | Kao et al. | |
| 6,549,866 | B1 | 4/2003 | Bhatnagar | |
| 6,648,981 | B2 | 11/2003 | McIntyre et al. | |
| 6,665,384 | B2 * | 12/2003 | Daum et al. | 379/102.03 |
| 6,668,568 | B2 | 12/2003 | Holmes et al. | |
| 6,795,871 | B2 | 9/2004 | Nolan et al. | |
| 6,826,267 | B2 * | 11/2004 | Daum et al. | 379/102.03 |
| 6,882,712 | B1 * | 4/2005 | Iggulden et al. | 379/102.03 |
| 6,953,919 | B2 * | 10/2005 | Clothier | 219/620 |
| 6,973,515 | B2 | 12/2005 | Kuerner et al. | |
| 7,136,709 | B2 * | 11/2006 | Arling et al. | 700/65 |
| 7,155,305 | B2 * | 12/2006 | Hayes et al. | 700/224 |
| 7,197,888 | B2 * | 4/2007 | LeClear et al. | 62/186 |
| 7,201,005 | B2 * | 4/2007 | Voglewede et al. | 62/126 |
| 7,290,398 | B2 * | 11/2007 | Wallace et al. | 62/157 |
| 7,308,483 | B2 * | 12/2007 | Philyaw | 709/217 |
| 7,363,031 | B1 * | 4/2008 | Aisa | 455/419 |
| 7,529,543 | B2 * | 5/2009 | Dale | 455/419 |
| 7,686,890 | B2 | 3/2010 | King et al. | |
| 7,903,838 | B2 * | 3/2011 | Hudnut et al. | 382/100 |
| 2001/0039190 | A1 * | 11/2001 | Bhatnagar | 455/450 |
| 2003/0136135 | A1 * | 7/2003 | Kim et al. | 62/125 |
| 2004/0004635 | A1 * | 1/2004 | King | 345/741 |
| 2004/0070491 | A1 * | 4/2004 | Huang et al. | 340/10.5 |
| 2005/0022848 | A1 * | 2/2005 | Crisp | 134/57 D |
| 2005/0031099 | A1 * | 2/2005 | Iggulden et al. | 379/102.03 |
| 2006/0178756 | A1 * | 8/2006 | Gotoh et al. | 700/9 |
| 2007/0021964 | A1 * | 1/2007 | Maenishi et al. | 705/1 |
| 2009/0090127 | A1 * | 4/2009 | Do | 62/449 |

FOREIGN PATENT DOCUMENTS

JP 09329339 A * 12/1997

OTHER PUBLICATIONS

Press, Marcia. "Geek My House: Building a Kitchen PC". Jun. 2, 2005. http://www.extremetech.com/electronics/75346-geek-my-house-building-a-kitchen-pc.*

* cited by examiner

UNIVERSAL CONTROLLER FOR A DOMESTIC APPLIANCE

BACKGROUND OF THE INVENTION

1. Field of the Invention

The present invention pertains to the art of domestic appliances and, more particularly, to a programmable controller for a domestic appliance.

2. Discussion of the Prior Art

Domestic appliances are quickly becoming more sophisticated devices. Almost every modern day appliance contains a computer or other form of electronic controller that operates various features of the appliance. For example, refrigerators come in a wide variety of models and styles that appeal to a wide range of consumers. Refrigerators range from high-end models that may include temperature controlled storage bins, water filters, water/ice dispensers, as well as various other advanced features or accessories, to lower-end models that may simply provide controls for establishing a desired temperature in a fresh food and/or freezer compartment. As each model has distinct features and/or accessories, a separate controller must be developed for each type or model of refrigerator.

In the highly competitive field of household appliances, there is a constant need to update, improve and streamline manufacturing processes, as well as reduce unit costs. The need to develop, install and store multiple types of controllers that accommodate different refrigerator models increases the unit cost of each appliance. In addition, maintaining numerous different controllers increases warehousing and supply costs.

Based on the above, there still exists a need for a universal refrigerator controller having stored therein a plurality of operating parameters for a plurality of refrigerator models, wherein the controller can be readily programmed to activate particular ones of the plurality of operating parameters associated with a particular refrigerator model.

SUMMARY OF THE INVENTION

The present invention is directed to a programmable universal controller for a domestic appliance shown in the form of a refrigerator. In a manner known in the art, the refrigerator includes an outer shell or cabinet having arranged therein fresh food and a freezer compartment. The refrigerator further includes at least one door, pivotally mounted to the cabinet, and a user interface. In accordance with the invention, the user interface includes a plurality of control elements for adjusting various operational parameters of the refrigerator. The user interface is operationally coupled to the programmable controller. The controller is provided with a non-volatile memory within which are stored a plurality of operating parameters that are associated with a plurality of distinct refrigerator models.

In further accordance with the invention, the refrigerator includes an identification element which, in the most preferred form of the invention, is constituted by a bar code tag affixed to the cabinet. In addition to the identification element, the refrigerator includes a communication device that is operatively connected to the controller. In accordance with one aspect of the invention, the communication device constitutes a wireless receiver capable of receiving remote signals that carry programming instructions. In accordance with another arrangement, the communication device is constituted by the plurality of control elements included with the controller. That is, programming instructions can be input to the controller through selective manipulation of the plurality of control elements.

During manufacturing, the identification element is read as the refrigerator either moves down a production line or awaits shipping. The identification element provides information to, for example, a remote computer regarding the particular refrigerator model, as well as additional information, such as various options that may have been incorporated into the refrigerator. At this point, programming instructions are sent through the communication device to the controller to activate particular ones of the plurality of operating parameters that are associated with the particular refrigerator model and any associated options.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
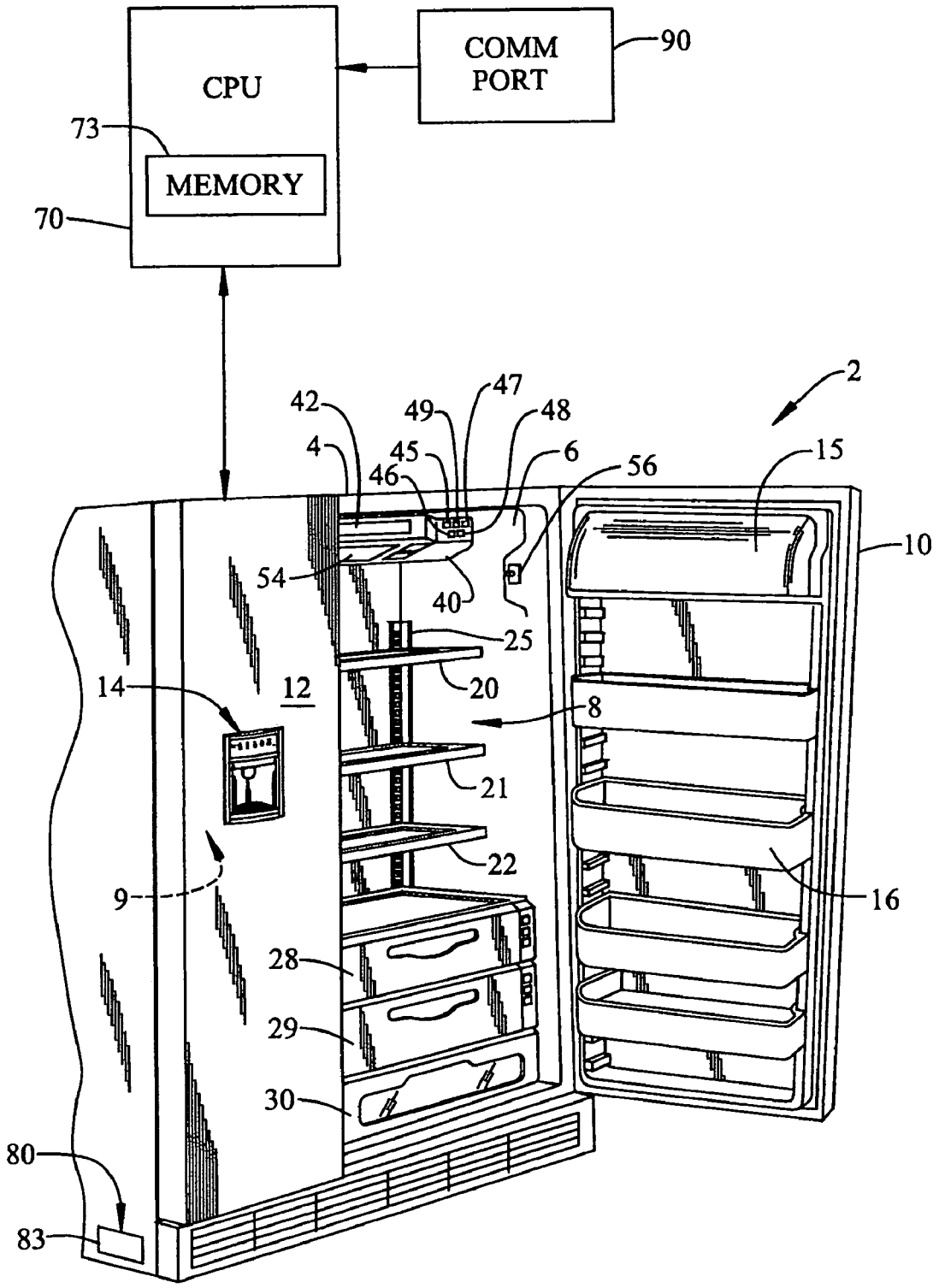
FIG. 1 is a partial, upper right perspective view of a domestic appliance incorporating a universal controller constructed in accordance with the present invention.

With initial reference to FIG. 1, a domestic appliance is shown in the form of a refrigerator 2 including an outer shell or cabinet 4 within which is positioned a liner 6 that defines at least one of a fresh food compartment 8 and a freezer compartment 9. In a manner known in the art, fresh food compartment 8 can be accessed by the selective opening of a fresh food door 10. In a similar manner, a freezer door 12 can be opened to access freezer compartment 9. In the embodiment shown, freezer door 12 includes a dispenser 14 that enables a consumer to retrieve ice and/or fresh water without accessing fresh food or freezer compartments 8 and 9. For the sake of completeness, door 10 of refrigerator 2 is shown to include a dairy compartment 15 and various vertically adjustable shelving units, one of which is indicated at 16.

In a manner also known in the art, fresh food compartment 8 is provided with a plurality of vertically height adjustable shelves 20-22 supported by a pair of shelf support rails, one of which is indicated at 25. At a lowermost portion of fresh food compartment 8 is illustrated various temperature or climate controlled bins 28 and 29, as well as a more conventional storage compartment 30. At an upper region of fresh food compartment 8 is arranged a temperature control housing or user interface 40. In the embodiment shown, interface 40 includes a display zone 42 and a plurality of control elements 45-49. Control elements 45-48 are constituted by temperature control elements for adjusting temperatures of fresh food compartment 8 and freezer compartment 13 respectively, while control element 49 is constituted by an auxiliary control element for re-setting a door alarm. For the sake of completeness, interface 40 is also shown to include a light 54 which, in a manner known in the art, is controlled by a switch 56 operated by opening and closing door 10.

In accordance with the invention, refrigerator 2 includes a CPU or controller 70 that is operatively coupled to user interface 40. Controller 70 includes a non-volatile memory 73 having stored therein a plurality of operating parameters, specifically a plurality of operating parameters associated with the operation and control of a plurality of refrigerator models. That is, stored in each controller 70 are the programming instructions for a number of different refrigerator models. In further accordance with the invention, refrigerator 2 is provided with an identification device 80 which, in the most preferred form of the invention, takes the form of a bar code tag 83 affixed to cabinet 4. Identification device 80 contains information regarding the particular model of refrigerator 2, as well as various features and/or accessories incorporated into the particular model. For example, identification device 80 will list various control modes associated with a particular model and available accessories such as dispenser 14 and temperature controlled bins 28 and 29.

In still further accordance with the invention, refrigerator 2 is provided with a communication port 90 which is operatively coupled to controller 70. Preferably, communication port 90 is constituted by a wireless interface capable of receiving remote transmissions of various mediums such as, for example, infrared or Blue Tooth™ technology. Alternatively, communication port 90 can simply be constituted by a plug or jack (not shown) incorporated into refrigerator 2 to which manufacturing or service personnel may connect, for example, a hand-held computer. In yet another arrangement, service or manufacturing personnel may simply interface with controller 70 through manipulation of control elements 45-49 on interface 40. Regardless of the particular interface chosen, it is simply important to note that manufacturing or service personnel can communicate with and program controller 70 in a manner that will be described more fully below.

Figure 2:
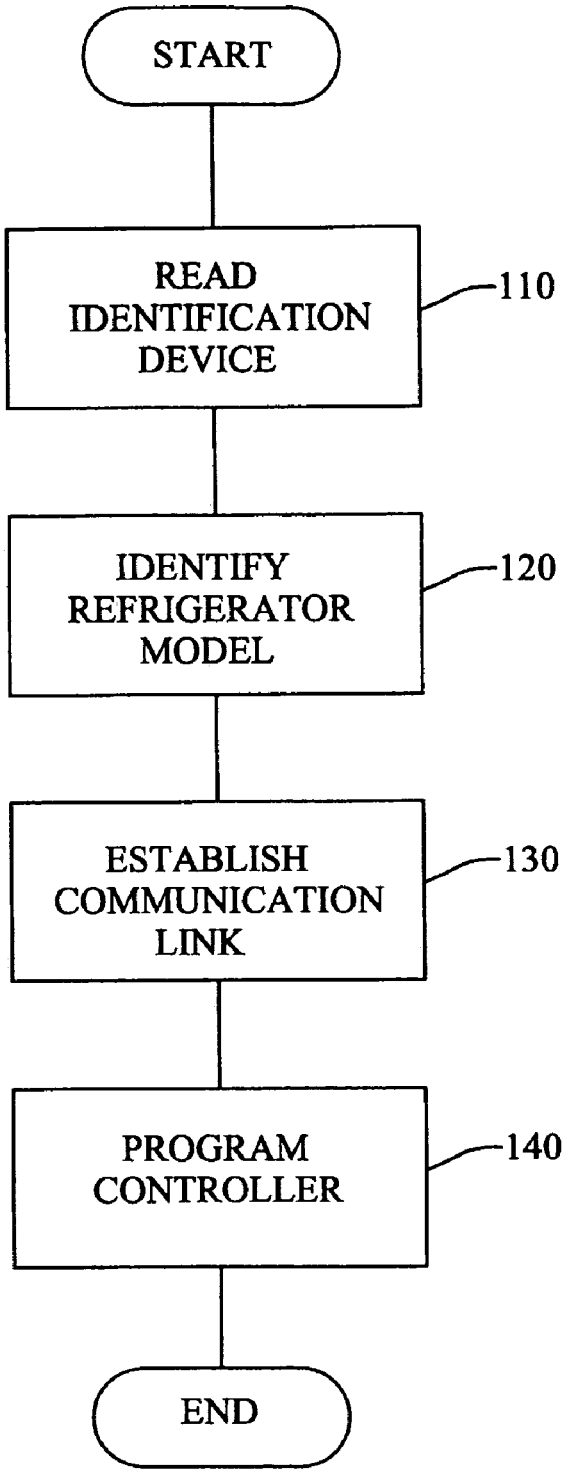
FIG. 2 is a flow chart detailing a method of identifying the domestic appliance and communicating programming instructions to the universal controller of FIG. 1.

In accordance with the most preferred form of the present invention, communication port 90 receives programming instructions for controller 70. More specifically, the programming instructions make available or activate select ones of the plurality of operating parameters stored within memory 73. With this arrangement, either during or after a manufacturing process, personnel can program controller 70 to control a particular refrigerator 2 having associated therewith various accessories and/or features. As best represented in FIG. 2, service personnel initially scan identification device 80 in step 110. In step 120, a particular refrigerator model having particular accessories and/or features is identified based on the information obtained in step 110. Having identified the particular refrigerator model, personnel establish a communication link with controller 70 through communication port 90 in step 130. Once a communication link is established, programming instructions are sent to controller 70 in step 140. More specifically, during step 140, programming instructions are issued to controller 70 which make available or activate various ones of the plurality of operating parameters, stored in memory 73, that are required for operation of the particular refrigerator model identified in step 120.

Once controller 70 has been properly programmed, refrigerator 2 is ready for delivery to wholesale or retail locations. By incorporating operating parameters that are associated with a plurality of refrigerator models and enabling programming of the controller to operate only those operating parameters necessary for the control of a particular refrigerator model, a single controller or CPU can be employed in numerous refrigerator models including a wide range of side-by-side, top mount and bottom mount styles. That is, instead of developing different controllers for each individual refrigerator model in production, a single controller can be installed into a refrigerator and thereafter programmed. In this manner, production, design and warehousing costs are reduced, which ultimately results in a net savings that can be passed onto the consumer.

Although described with reference to a preferred embodiment of the invention, it should be readily understood that various changes and/or modifications can be made to the invention without departing from the spirit thereof. For instance, while the domestic appliance is shown and described as a refrigerator, it should be readily understood that the present invention could also be employed in dishwashers, laundry appliances, ovens, stoves and vending machines. In addition, while the identification device is described as a bar code affixed to a cabinet, the identification device can be incorporated into model tag numbers which are thereafter removed either prior or subsequent to the sale or the refrigerator. In addition, while the specification describes a wireless communication arrangement using IR and Blue Tooth™ technologies when interfacing with a controller, various other communication technologies can be employed. Also, while interface 40 is shown mounted at an upper region of the fresh food compartment, various other locations, such as on door 10, door 12, dispenser 14 or the like, could also be employed. In general, the invention is only intended to be limited by the scope of the following claims.

We claim:

1. A domestic appliance comprising:

a cabinet;

a door pivotally mounted relative to the cabinet;

a universal controller for regulating operation of the domestic appliance;

a non-volatile memory associated with the controller, said non-volatile memory having stored therein a plurality of operating parameters associated with a plurality of models of the appliance;

means for identifying a particular model of the appliance, with said particular model having associated therewith only particular ones of the plurality of operating parameters; and means for communicating with the controller to activate the particular ones of the operating parameters associated with the particular model of the appliance.

2. The domestic appliance according to claim 1, wherein the identifying means constitutes a bar code.

3. The domestic appliance according to claim 2, wherein the bar code is affixed to the cabinet.

4. The domestic appliance according to claim 1, wherein the communicating means constitutes a wireless communication port operatively coupled to the controller, said wireless communication port being adapted to receive programming data that activates the particular ones of the operating parameters associated with the particular domestic appliance.

5. The domestic appliance according to claim 4, wherein the communicating means constitutes a wireless receiver arranged in the domestic appliance, said wireless receiver being operatively connected to the controller.

6. The domestic appliance according to claim 1, further comprising: a user interface having a plurality of control elements for inputting operating parameters of the domestic appliance, said communicating means being constituted by manual inputs to the controller through the control elements on the user interface.

7. The domestic appliance according to claim 1, wherein the plurality of operating parameters include compartment temperature control points, minimum and maximum set points, thermal performance data and product feature programming.

8. The domestic appliance according to claim 7, wherein the plurality of operating parameters include instructions for controlling a plurality of domestic appliance accessories.

9. The domestic appliance according to claim 8, wherein the domestic appliance constitutes a refrigerator.

10. The domestic appliance according to claim 9, wherein the plurality of domestic appliance accessories includes dispenser controls and temperature controlled storage bins.

11. A method of programming a universal domestic appliance controller comprising:

reading an indicator attached to a domestic appliance, said indicator designating a particular appliance model or features associated with the particular appliance model;

identifying the appliance model based upon the indicator;

communicating with a universal controller associated with the appliance, said controller including a memory having stored therein a plurality of operating parameters associated with a plurality of distinct appliance models; and programming the controller to activate particular ones of the plurality of operating parameters that correspond to the appliance model designated by the indicator.

12. The method of claim 11, wherein reading the indicator constitutes scanning a bar code carried by the appliance.

13. The method of claim 12, wherein the bar code is affixed to a cabinet of the appliance.

14. The method of claim 11, wherein communicating with the controller constitutes wirelessly transmitting signals to the controller.

15. The method of claim 11, wherein the domestic appliance includes a cabinet having an associated user interface, and communicating with the controller constitutes inputting commands through control elements provided on the user interface, said control elements being operatively connected to the controller.

* * * * *